US009573007B2

(12) United States Patent
Abels et al.

(10) Patent No.: US 9,573,007 B2
(45) Date of Patent: Feb. 21, 2017

(54) FIRE PROTECTION SPRINKLER

(71) Applicant: Tyco Fire Products LP, Lansdale, PA (US)

(72) Inventors: Bernhard Abels, Warwick, RI (US); Stefan Vaeth, Wertheim (DE)

(73) Assignees: Tyco Fire Products LP, Lansdale, PA (US); FLN FEUERLOSCHGERATE NEURUPPIN VERTRIEBS GMBH, Neuruppin (DE)

( * ) Notice: Subject to any disclaimer, the term of this patent is extended or adjusted under 35 U.S.C. 154(b) by 207 days.

(21) Appl. No.: 14/214,200

(22) Filed: Mar. 14, 2014

(65) Prior Publication Data

US 2016/0310773 A1 Oct. 27, 2016

Related U.S. Application Data

(60) Provisional application No. 61/788,039, filed on Mar. 15, 2013.

(51) Int. Cl.
*A62C 37/11* (2006.01)

(52) U.S. Cl.
CPC ..... *A62C 37/11* (2013.01)

(58) Field of Classification Search
CPC ..... A62C 37/08; A62C 37/10; A62C 37/11; A62C 37/14; A62C 35/62
USPC ..... 169/17, 37, 90, 38, 39, 40, 41
See application file for complete search history.

(56) References Cited

U.S. PATENT DOCUMENTS 4,109,727 A 8/1978 Job
4,796,710 A 1/1989 Job
4,930,578 A 6/1990 Barnett et al.
4,991,656 A 2/1991 Polan
4,993,496 A 2/1991 Riedle et al.
5,080,176 A 1/1992 Polan et al.
5,299,645 A 4/1994 Hoening et al.
5,609,211 A 3/1997 Meyer et al.
5,862,994 A 1/1999 Pounder et al.
5,967,238 A 10/1999 Pepi et al.
6,964,307 B1 * 11/2005 Dushkin ..... A62C 37/14 169/37

(Continued)

OTHER PUBLICATIONS

U.S. Appl. No. 61/788,039, filed Mar. 15, 2013, dated May 23, 2016, 85 pages.

(Continued)

*Primary Examiner* — Christopher Kim
(74) *Attorney, Agent, or Firm* — Perkins Coie LLP

(57) ABSTRACT

A fire protection sprinkler that includes a body defining an internal passageway extending along a sprinkler axis between an inlet end and an outlet end to define a passageway length and a nominal K-factor greater than 16. A deflector is supported and spaced from the outlet end by a pair of support arms. The sprinkler includes means for allowing a flow of water from the outlet end of the body. The means includes a closure assembly having a body defining a blind bore and a thermally responsive glass bulb. The glass bulb has a first end disposed within the blind bore defining a first seat diameter and a second end defining a second seat diameter. The glass bulb has a bulb length that is greater than the length of the internal passageway and a maximum wall thickness less than the difference between the bulb length and the passageway length.

17 Claims, 3 Drawing Sheets

(56) References Cited

U.S. PATENT DOCUMENTS

| | | | |
|---|---|---|---|
| 6,976,543 | B1 | 12/2005 | Fischer |
| 7,343,980 | B2 | 3/2008 | Pahila |
| 8,402,985 | B2 | 3/2013 | Schmalfuss |
| 8,408,321 | B2 | 4/2013 | Golinveaux et al. |
| 8,602,118 | B2 | 12/2013 | Pigeon |
| 8,714,180 | B2 | 5/2014 | Klug et al. |
| 2008/0073088 | A1 | 3/2008 | Ide et al. |
| 2009/0242218 | A1 | 10/2009 | Van Schoor et al. |
| 2014/0158381 | A1 | 6/2014 | Orr et al. |

OTHER PUBLICATIONS

Central Sprinkler Company, "ULTRA K-17, Specific Application 30'-0" Building with 25'-0" Storage No In-Rack Sprinklers Required", 1997, 4 pages.

Tyco Fire Suppression & Building Products, "Ultra K17-16.8 K-factor Upright Specific Application Control Mode Sprinkler Standard Response", Jan. 2009, pp. 1-4.

* cited by examiner

FIRE PROTECTION SPRINKLER

PRIORITY DATA

This application claims the benefit of U.S. Provisional Application No. 61/788,039 filed Mar. 15, 2013, which application is incorporated herein by reference in its entirety.

TECHNICAL FIELD

This invention relates to fire protection sprinklers, and more particularly storage fire protection sprinklers preferably for installation in dry-pipe sprinkler systems.

BACKGROUND

In its 2013 publication of "NFPA 13: Standard for the Installation of Sprinkler Systems" (herein after "NFPA 13"), the National Fire Protection Association (NFPA) defines an automatic sprinkler as "a fire suppression or control device that operates automatically when its heat-activated element is heated to its thermal rating or above, allowing water to discharge over a specified area." A known heat-activated element for use in an automatic sprinkler is a thermally responsive frangible bulb, as seen for example, in U.S. Pat. No. 5,967,238. An automatic sprinkler can be characterized by the physical dimensions and thermal characteristics, i.e., nominal temperature rating and Response Time Index (RTI), of its thermally responsive bulb. U.S. Pat. No. 5,967,238 describes a thermally responsive frangible bulb with a maximum bulb diameter of about 0.1 inch and a maximum bulb length of less than 1 inch. Other known thermally responsive bulbs are manufactured with a maximum length of more than ¾ inch, a maximum RTI of 90 meter$^{1/2}$ sec$^{1/2}$ ($m^{1/2}s^{1/2}$) and a nominal temperature rating defined under NFPA 13 being any one of: (i) ordinary 135° F.-170° F.; (ii) intermediate 175° F.-225° F.; (iii) high 250° F.-300° F.; (iv) extra high 325° F.-375° F.; (v) very extra high 400° F.-475° F.; and (vi) ultra high 500° F.-575° F.

In addition to its thermally responsive bulb, an automatic sprinkler can also be characterized by its discharge characteristics. A sprinkler's discharge characteristics can be identified by a nominal K-factor which is defined as an average flow of water in gallons per minute through the internal passageway divided by a square root of pressure of water fed into the inlet end of the internal passageway in pounds per square inch gauge: $Q=K\sqrt{P}$ where P represents the pressure of water fed into the inlet end of the internal passageway through the body of the sprinkler, in pounds per square inch gauge (psig); Q represents the flow of water from the outlet end of the internal passageway through the body of the sprinkler, in gallons per minute (gpm); and K represents the nominal K-factor constant in units of gallons per minute divided by the square root of pressure expressed in psig. Known nominal K-factors include (with the K-factor range shown in parenthesis): (i) 14.0 (13.5-14.5) GPM/(PSI)$^{1/2}$; (ii) 16.8 (16.0-17.6) GPM/(PSI)$^{1/2}$; (iii) 19.6 (18.6-20.6) GPM/(PSI)$^{1/2}$; (iv) 22.4 (21.3-23.5) GPM/(PSI)$^{1/2}$; (v) 25.2 (23.9-26.5) GPM/(PSI)$^{1/2}$; (vi) 28.0 (26.6-29.4) GPM/(PSI)$^{1/2}$; and (vii) 33.6 (31.9-35.28) GPM/(PSI)½.

For automatic sprinklers with a nominal K-factor of 16 GPM/(PSI)$^{1/2}$ and larger, the heat-activated element might be a strut and lever arrangement with a thermally responsive solder element. U.S. Pat. Nos. 5,609,211; 8,602,118; and 8,408,321 and U.S. Patent Publication No. 20080073088 generally show and describe sprinklers with a thermally actuated bulb with a nominal K-factor of 25.2 GPM/(PSI)$^{1/2}$ or larger. Although these patents, for example U.S. Pat. No. 8,408,321, indicate that sprinklers having a nominal K-factor larger than 25.2 GPM/(PSI)$^{1/2}$ with a bulb-type trigger are applicable for the described dry-pipe sprinkler system, the patent does not describe any particular details of the glass bulb, bulb seating and/or applications for combining a sprinkler with a K-factor greater than 25.2 GPM/(PSI)$^{1/2}$ with a glass bulb.

SUMMARY OF THE INVENTION

Preferred embodiments provide a fire protection sprinkler for storage preferably in a dry-pipe sprinkler system. The preferred sprinkler includes a body defining an internal passageway extending along a sprinkler axis between an inlet end and an opposite outlet end, the internal passageway having a nominal K-factor greater than 16. The sprinkler preferably includes a pair of support arms each having a first end and a second end, the first end extending from the body; and a deflector axially supported and spaced from the outlet end by the pair of support arms. The sprinkler includes means for allowing the flow of water to flow from the outlet end of the internal passageway and be distributed by the deflector to control a fire in a rack storage arrangement of at least one of Class I-IV and Cartoned Unexpanded Group A Plastics commodity as defined by NFPA 13 (2013 Edition) stored at a nominal 40-ft storage height when the sprinkler is disposed in a grid of sprinklers in a dry-pipe piping system proximate a nominal 45 ft. high ceiling or higher.

The preferred means includes a closure assembly having a body with a first surface and a second surface spaced from the first surface. The first surface preferably defines a blind bore that includes an entrance at the first surface and a terminal end formed between the first and second surfaces. The second surface is disposed in the passageway so as to axially align the body along the sprinkler axis. A thermally responsive glass bulb is disposed substantially coaxially with the sprinkler axis. The glass bulb has a first end disposed within the blind bore and contiguous with the seat of the blind bore to define a first seat diameter. A second end of the glass bulb defines a second seat diameter. A bulb length between the first seat diameter and the second seat diameter is greater than the length of the internal passageway between an inlet end and an opposite outlet end. The glass bulb has a maximum wall thickness less than the difference between the bulb length and the passageway length.

DESCRIPTION OF DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

Like reference symbols in the various drawings indicate like elements.

DETAILED DESCRIPTION

Figure 1:
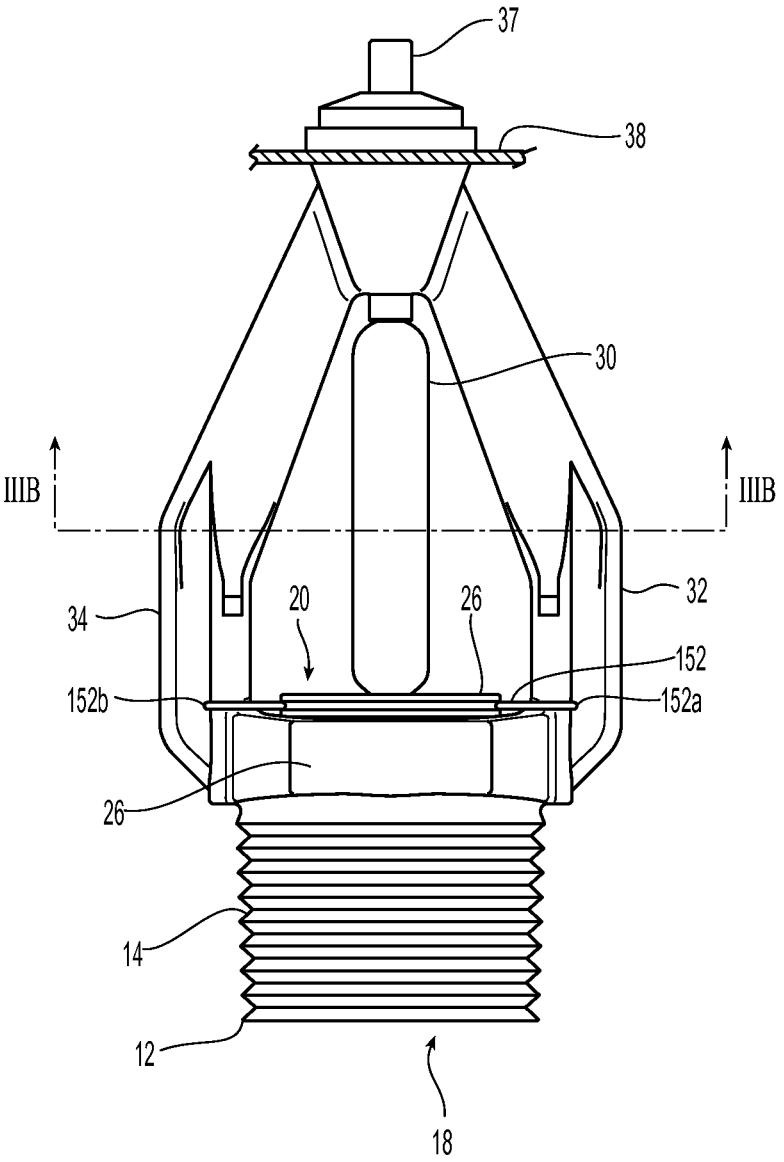
FIG. 1 is an elevation and plan view of a preferred sprinkler assembly.
Figure 2:
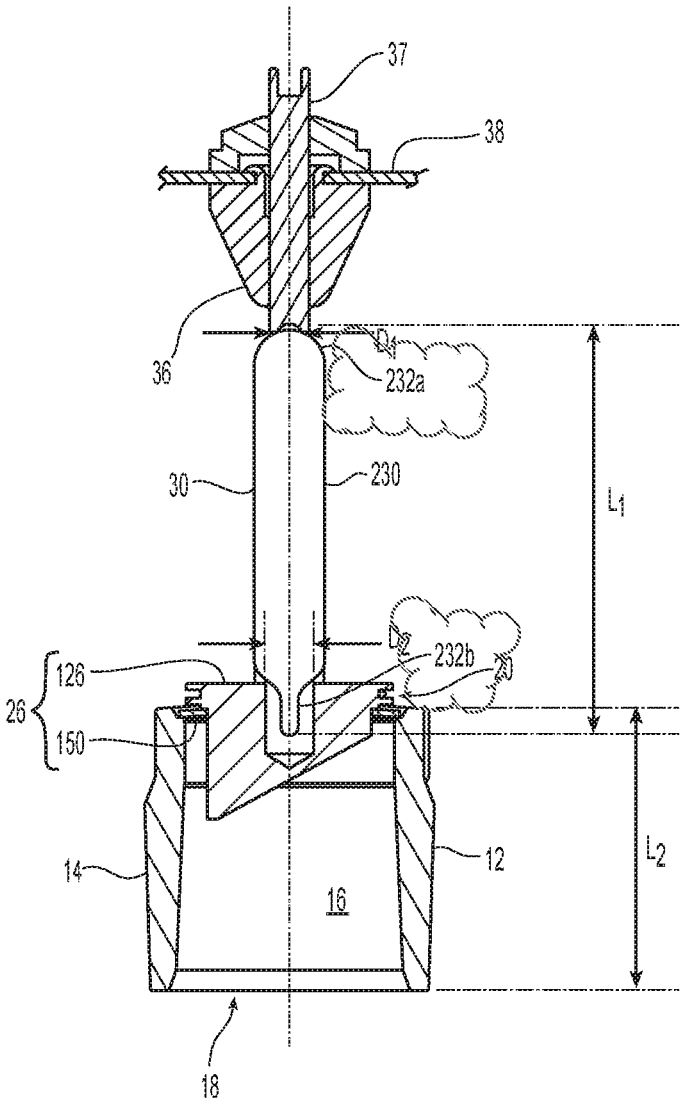
FIG. 2 is a cross-sectional view of the sprinkler of FIG. 1.

According to a preferred embodiment, a fire protection sprinkler assembly 10 is provided for use in protection of at least extra hazard and high piled storage occupancies. Referring to FIGS. 1 and 2, an upright-type fire protection sprinkler assembly 10 includes a one-piece frame 12 having a body 14 defining an internal passageway 16 that extends between an inlet end 18 and an opposite outlet end 20 to define a sprinkler axis A-A. The fire protection sprinkler 10 has a nominal discharge coefficient or K-factor of greater than about 16.0. In preferred embodiments, the nominal K-factor can be between about 16.8 and about 28.0, preferably between about 22.4 and about 28.0, more preferably between about 25.2 and about 28.0, and most preferably a nominal K-factor of 25.0. Accordingly, the nominal K-factor can be between a nominal 16.8 GPM/$(PSI)^{1/2}$ and a nominal 28.0 GPM/$(PSI)^{1/2}$, is more preferably at least 25.2 GPM/$(PSI)^{1/2}$, and is even more preferably greater than 28.0 GPM/$(PSI)^{1/2}$. In one aspect, the nominal K-factor is preferably over 28.0 GPM/$(PSI)^{1/2}$ by a whole multiple of 5.6 (plus or minus 5%) such as for example a nominal K-factor of 33.6 GPM/$(PSI)^{1/2}$ (31.9-35.28).

Cooperating threads 22 provided on the outside surface 24 of the body in the region of the inlet end 18 and in the internal passageway 16 permit the sprinkler 10 to be coupled to a threaded fitting adapted for connection to a supply pipe, for delivery of water, or other fire fighting fluid. The outlet end 20 of internal passageway 16 has an axis, A. At the outlet end 20 of the body 14, the frame 12 is enlarged into a hexagonally shaped, circumferential flange 26, with major, opposite parallel flat surfaces or "flats." The flats are positioned for engagement with an open-ended wrench or a specially designed sprinkler wrench having a hexagonally shaped recess for threading and tightening the sprinkler 10 into the threaded fitting, TF, for connection to the fluid supply pipe.

The frame 12 preferably includes a pair of support arms 32, 34 extending generally away from opposite sides of the outlet end 20 of the body 14 and meeting to form an apex 36. The apex is preferably aligned with axis A-A and axially spaced from the outlet end 20 of the internal passageway. A deflector 38, engaged with apex 36 is axially spaced from the outlet end 2 to distribute a flow of fire-fighting fluid, e.g., water, from the outlet end 20 about the sprinkler 100. The deflector 38 is preferably centrally and coaxially aligned with the sprinkler axis A-A. The deflector can be any suitable deflector to provide a desired spray pattern. Referring to FIG. 1, the deflector is generically shown with a planar portion centrally disposed and perpendicular to the sprinkler axis A-A. Water discharged from the outlet end 20 impacts the central portion for at least radial distribution of the fluid toward to the periphery (not shown) of the deflector In one aspect of the preferred sprinkler assembly 10, the preferred pair of arms 32, 34 are disposed about the sprinkler body 14 to so as to preferably define a plane P1 which bisects the deflector 38.

The sprinkler 100 and its deflector 38 are preferably configured to provide an automatic sprinkler assembly for the protection of a storage occupancy. Accordingly, the sprinkler 10 includes means for allowing the flow of water to flow from the outlet end 20 of the internal passageway 16 and be distributed by the deflector 38 to control a fire in a rack storage arrangement.

More preferably, the sprinkler 10 includes means for allowing the flow of water to flow from the outlet end 20 and be distributed by the deflector 38 to address a fire in a rack storage arrangement of at least one of Class I-IV and Cartoned Unexpanded Group A Plastics commodity as defined by NFPA 13 (2013 Edition) stored at a nominal 40-ft storage height when the sprinkler is disposed in a grid of sprinklers in a dry-pipe piping system and installed proximate at a nominal 45 ft. high ceiling. Accordingly in one preferred aspect, the sprinkler 10 includes means for allowing the flow of water to flow from the outlet end 20 for distributed in the protection of a stored commodity at least at a nominal 40-ft storage height when the sprinkler is disposed in a grid of sprinklers in a dry-pipe piping system and installed proximate at a nominal 45 ft. high ceiling. The preferred means for allowing the fluid flow from the outlet 20 for distribution includes a closure assembly 26 with a heat-responsive trigger 30 mounted to the sprinkler frame 12 to maintain the sprinkler assembly 10 in an unactuated, standby or non-fire condition, e.g., as shown in FIGS. 1 and 2 to releasably secure the outlet end 20 of the internal passageway 16 against a flow of water. A preferred heat-responsive trigger 30 of the sprinkler 10 and its actuation is defined by its nominal temperature rating and Response Time Index, or RTI. The trigger 30 is configured to actuate at or define a preferred nominal temperature rating of 286° F. and define a preferred RTI of 135 $meter^{1/2}sec^{1/2}$ $(m^{1/2}s^{1/2})$ to about 160 $meter^{1/2}sec^{1/2}$ $(m^{1/2}s^{1/2})$. The trigger may have another nominal temperature rating provided it is suitable for the hazard, occupancy or storage being protected, including, for example as defined under NFPA 13: (i) ordinary 135° F.-170° F.; (ii) intermediate 175° F.-225° F.; (iii) high 250° F.-300° F.; (iv) extra high 325° F.-375° F.; (v) very extra high 400° F.-475° F.; and (vi) ultra high 500° F.-575° F. Moreover, the heat-responsive trigger 30 can define alternate ranges of RTI, which can range from at least 130 $meter^{1/2}sec^{1/2}$ $(m^{1/2}s^{1/2})$ to 160 $meter^{1/2}$ $sec^{1/2}$ $(m^{1/2}s^{1/2})$, preferably at least 135 $meter^{1/2}sec^{1/2}$ $(m^{1/2}s^{1/2})$ to about 160 $meter^{1/2}$ $sec^{1/2}$ $(m^{1/2}s^{1/2})$, more preferably 150 $meter^{1/2}$ $sec^{1/2}$ $(m^{1/2}$ $s^{1/2})$ to about 160 $meter^{1/2}$ $sec^{1/2}$ $(m^{1/2}$ $s^{1/2})$, and is even more preferably 160 $meter^{1/2}$ $sec^{1/2}$ $(m^{1/2}$ $s^{1/2})$. In response to a predetermined temperature condition indicative of a fire, the heat-responsive trigger 30 actuates, releasing closure assembly 26, thereby allowing the flow of water supplied to the inlet end 18, through the internal passageway 16, and out through the outlet end 20.

Figure 3:
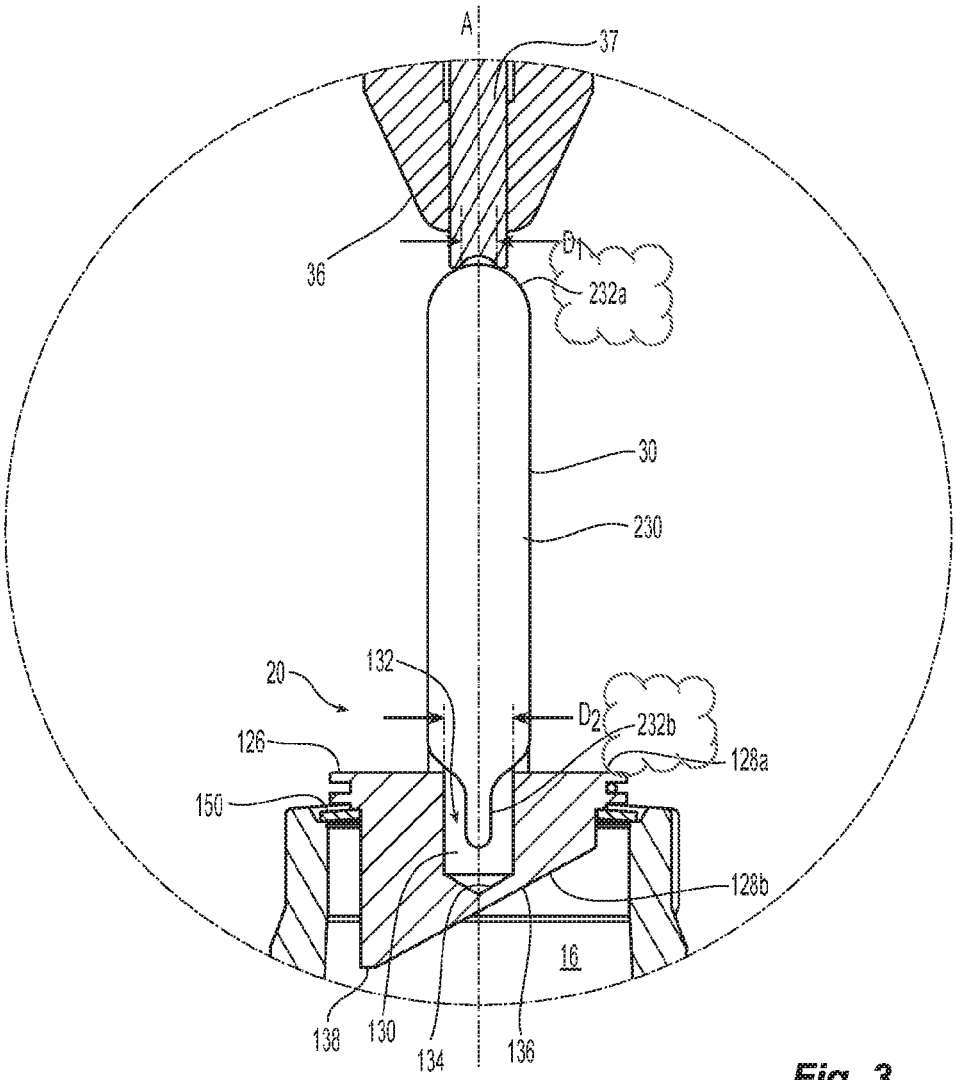
FIG. 3 is a detailed partial cross-sectional view of the closure and trigger assemblies in the sprinkler assembly of FIG. 1.
Figure 4:
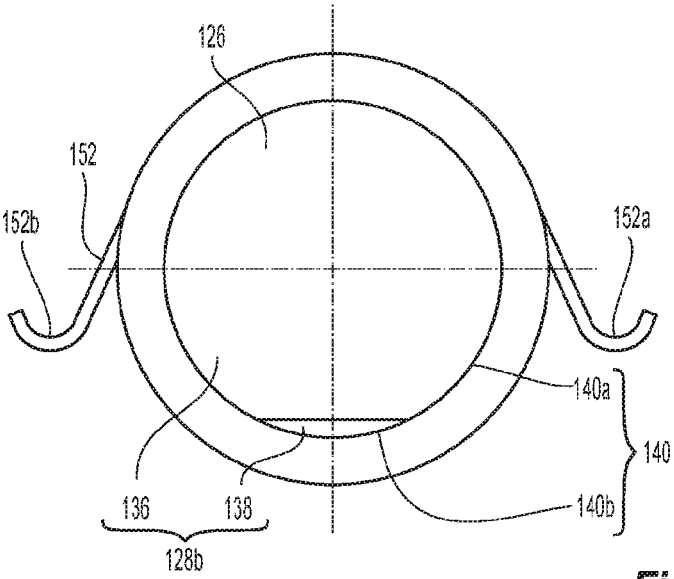
FIG. 4 is a plan view of the closure assembly for use in the sprinkler assembly of FIG. 1.

Preferred embodiments of the closure assembly 26 and the heat-responsive trigger 30 are shown in FIG. 2 and the detailed view of FIG. 3. The closure assembly 26 preferably includes a body 126 having first surface **128*a* facing the deflector and a second surface 128*b* spaced opposite the first for location within the internal passageway 16 of the sprinkler frame 12 to preferably axially align the body 126 along the sprinkler axis A-A. The first surface 128*a* preferably defines a blind bore 130 disposed along the sprinkler axis. The blind bore 130 is defined by an entrance 132 formed at the first surface 128*a* and a terminal end 134 formed between the first and second surfaces 128*a*, 128*b*. As located in the passageway 16, the second surface 128*b* preferably includes a first portion 136 oblique to the sprinkler axis A-A and a second portion 138 substantially perpendicular to the sprinkler axis AA. As seen in FIG. 4, the body 126 includes a perimeter 140 disposed or circumscribed about the sprinkler axis A-A. The perimeter 140 preferably includes a preferred first section 140*a* disposed between the first surface 128*a* and the terminal end 134 of the blind bore 130 and a second section 140*b* between the terminal end 134 of the blind bore 130 and the second surface 128*b*. Referring again to FIG. 3, the closure assembly 26 further preferably includes a metallic annulus 150 disposed on a support surface 142 between the first surface 128***a* and the second surface 128*b* of the body 12 to seal internal passageway 16. The metallic annulus 150 can be embodied as a Belleville Spring, to bias the body 126 distally out of the outlet end 20 of the passageway 16. The annulus 150 is preferably annular having a central portion surrounding the body 126 between the first surface 128*a* and the second surface 128*b*. Further preferably surrounding the body 26 to facilitate ejection of the annulus and body upon thermal actuation is a spring member 152 having a first end 152*a* and an opposite second end 152*b*, as seen in FIG. 4, which are disposed about the passageway 16. The first and second ends 152*a*, 152*b* are engaged with the arms 32, 34.

The heat responsive trigger 30 is preferably embodied as a thermally responsive glass bulb 230 having a first end 232*a* and a second end 232*b* to define a trigger axis preferably substantially coincident or aligned with the sprinkler axis A-A. The second end 232*b* is preferably disposed within the blind bore 130 of the sealing body 126 and contiguous with the entrance or seat 132 of the blind bore 130. The first end 232*a* of the bulb 230 is preferably contiguous with a compression member 37. The first end 232*a* of the bulb 230 defines a first a seat diameter D1 and the second end 232*b* defines a second seat diameter D2. The first seat diameter D1 is preferably less than the second seat diameter D2. In one particular embodiment, the first diameter seat D1 is about three millimeters (3 mm.) preferably equal to the diameter of the spherical recess at the distal end of the compression member 37. The second diameter seat D2 is about 5.5 mm preferably equal to the diameter of the seat 132 of the blind bore 130. Accordingly, the first and second ends 232*a*, 232*b* preferably define a preferred ratio of first to second seat diameter D1:D2 which ranges from about 0.5:1 to about 0.6:1. The bulb 230 further preferably defines a bulb length L1 between the first and second ends 232*a*, 232*b*. The passageway 16 of the sprinkler frame 12 defines a passageway length L2 that extends between the inlet end 18 and the outlet end 20. In a preferred embodiment of the sprinkler assembly 10, the bulb length L1 is greater than the passageway L2. In one preferred embodiment of the bulb 230, the bulb length is preferably greater than one inch and is more preferably about 1.5 inches (40 mm.). The passageway length L2 is preferably ranges from about 1.5 inches to about 1.3 inches, preferably about 1.25 inches and is more preferably 1.28 inches. The glass bulb 230 includes an internal surface to define a inner space for holding the thermally responsive liquid. Accordingly, the bulb 230 preferably defines a wall thickness between the outer and inner surface of the bulb. The bulb 230 preferably defines a maximum wall thickness that is less than the difference between the bulb length L1 and the passageway length L2. In one preferred embodiment of the bulb 230, the maximum wall thickness is about 1 mm to define a preferred ratio of maximum thickness to bulb length which can range from 1:30 to about 1:40.

A number of embodiments of the invention have been described. Nevertheless, it will be understood that various modifications may be made without departing from the spirit and scope of the invention. For example, although in the presently preferred embodiment, as described above, the deflector is mounted to the body by a pair of support arms, other numbers of support arms are contemplated, e.g. one support arm, or three or more support arms. Where other than two support arms, arrayed at 180° are employed, a plane of the support arms means a plane generally through at least one support arm and through the axis, A. Accordingly, it is intended that the present invention not be limited to the described embodiments, but that it has the full scope defined by the language of the following claims, and equivalents thereof.

What is claimed is:

1. A fire protection sprinkler in a dry-pipe sprinkler system comprising:

a frame body defining an internal passageway extending along a sprinkler axis between an inlet end and an opposite outlet end to define a passageway length, the internal passageway having a nominal K-factor of at least 25, where the K-factor equals an average flow of water in gallons per minute through the internal passageway divided by a square root of pressure of water fed into the inlet end of the internal passageway in pounds per square inch gauge;

a pair of support arms each having a first end and a second end, the first end extending from the frame body; and a deflector centered and axially aligned with the sprinkler axis, the deflector being supported by the second end of the pair of support arms so as to be spaced from the outlet end of the internal passageway, the pair of support arms extending from the first end to the second end toward the axis so as to form an apex aligned along the axis; and means for allowing the flow of water to flow from the outlet end of the internal passageway to be distributed by the deflector to address a fire in a rack storage arrangement of at least one of Class I-IV and Cartoned Unexpanded Group A Plastics commodity as defined by NFPA 13 (2013 Edition) stored at least at a nominal 40-ft storage height when the sprinkler is disposed in a grid of sprinklers in a dry-pipe piping system and installed proximate a nominal 45 ft. high ceiling or higher, the means including:

a closure assembly having a body with a first surface and a second surface spaced from the first surface, the first surface defining a blind bore that includes an entrance at the first surface and a terminal end formed between the first and second surfaces, the second surface being disposed in the passageway so as to axially align the body of the closure assembly along the sprinkler axis; and a heat-responsive trigger that includes a thermally responsive glass bulb disposed substantially coaxial with the sprinkler axis, the glass bulb having a first end and a second end disposed within the blind bore and contiguous with a seat of the blind bore, the first end having a first seat diameter and the second end having a second seat diameter, a bulb length between the first seat diameter and the second seat diameter being greater than the length of the internal passageway between an inlet end and an opposite outlet end, the glass bulb having a maximum wall thickness less than the difference between the bulb length and the passageway length.

2. The fire protection sprinkler of claim 1, wherein the rack storage arrangement comprises a double-row rack storage arrangement of Cartoned Unexpanded Group A Plastics commodity stored at a nominal 40-ft. storage height.

3. The fire protection sprinkler of claim 1, wherein the glass bulb has a nominal temperature rating of 286° F. and a response time index of 130 $meter^{1/2}$ $sec^{1/2}$ ($m^{1/2}s^{1/2}$) to 160 $meter^{1/2}$ $sec^{1/2}$ ($m^{1/2}s^{1/2}$).

4. The fire protection sprinkler of claim 3, wherein the response time index ranges from 135 $meter^{1/2}$ $sec^{1/2}$ ($m^{1/2}s^{1/2}$) to 160 $meter^{1/2}$ $sec^{1/2}$ ($m^{1/2}s^{1/2}$).

5. The fire protection sprinkler of claim 4, wherein the response time index ranges from 150 $meter^{1/2}$ $sec^{1/2}$ ($m^{1/2}s^{1/2}$) to 160 $meter^{1/2}sec^{1/2}$ ($m^{1/2}s^{1/2}$).

6. The fire protection sprinkler of claim 1, wherein the bulb length is about 1.5 inches (40 mm).

7. The fire protection sprinkler of claim 1, wherein the first seat diameter is less than the second seat diameter and a ratio of the first seat diameter to the second seat diameter is approximately 0.5 to 0.6:1.

8. The fire protection sprinkler of claim 7, wherein the second surface of the body of the closure assembly has a first portion oblique to the sprinkler axis and a second portion substantially perpendicular to the sprinkler axis, the first portion having a perimeter disposed about the sprinkler axis, the perimeter having a first section disposed between the first surface and the terminal end of the blind bore and a second section between the terminal end of the blind bore and the second surface, the closure assembly further comprising:

a metallic annulus disposed on a support surface between the first surface and second surface of the body, the metallic annulus sealing the inlet end of the internal passageway; and a spring having a central portion that surrounds a portion of the body between the first surface and the second surface and opposed ends that contact the pair of arms.

9. The fire protection sprinkler of claim 1, wherein the bulb length is greater than 1.0 inch, the glass bulb having a wall thickness of about 2 percent of the bulb length and a response time index of about 160 $meter^{1/2}$ $sec^{1/2}$ ($m^{1/2}s^{1/2}$).

10. The fire protection sprinkler of claim 9, wherein the bulb length is about 1.5 inches (40 mm).

11. The fire protection sprinkler of claim 1, wherein the second surface of the body of the closure assembly has a first portion oblique to the sprinkler axis and a second portion substantially perpendicular to the sprinkler axis, the first portion having a perimeter disposed about the sprinkler axis, the perimeter having a first section disposed between the first surface and the terminal end of the blind bore and a second section between the terminal end of the blind bore and the second surface, the closure assembly further comprising:

a metallic annulus disposed on a support surface between the first surface and second surface of the body, the metallic annulus sealing the inlet end of the internal passageway; and a spring having a central portion that surrounds a portion of the body between the first surface and the second surface and opposed ends that contact the pair of arms.

12. The fire protection sprinkler of claim 11, wherein the thermally responsive bulb has a nominal temperature rating of 286° F., the first end being contiguous with a compression member, the bulb length being greater than 1.0 inch, the glass bulb having a wall thickness of about 2 percent of the bulb length and a response time index of about 135 $meter^{1/2}$ sec ($m^{1/2}s^{1/2}$) to about 160 $meter^{1/2}$ $sec^{1/2}$ ($m^{1/2}s^{1/2}$).

13. The fire protection sprinkler of claim 12, wherein the bulb length is about 1.5 inches (40 mm).

14. The fire protection sprinkler of claim 13, wherein the first seat diameter is less than the second seat diameter and a ratio of the first seat diameter to the second seat diameter is approximately 0.5 to 0.6:1.

15. The fire protection sprinkler of claim 14, wherein the glass bulb has a maximum wall thickness between an outside surface and an inside surface and a length between the first seat diameter and the second seat diameter, a ratio of the maximum wall thickness to the length ranging from 1:30 to 1:40.

16. The fire protection sprinkler of claim 15, wherein the bulb length is about 1.5 inches (40 mm).

17. The fire protection sprinkler of claim 15, wherein the first seat diameter is less than the second seat diameter and a ratio of the first seat diameter to the second seat diameter is approximately 0.5 to 0.6:1.

* * * * *